US008531169B2

(12) United States Patent
Marinca

(10) Patent No.: US 8,531,169 B2
(45) **Date of Patent: *Sep. 10, 2013**

(54) METHOD AND CIRCUIT FOR LOW POWER VOLTAGE REFERENCE AND BIAS CURRENT GENERATOR

(75) Inventor: Stefan Marinca, Limerick (IE)

(73) Assignee: Analog Devices, Inc., Norwood, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/544,609

(22) Filed: Jul. 9, 2012

(65) Prior Publication Data

US 2012/0274306 A1 Nov. 1, 2012

Related U.S. Application Data

(63) Continuation of application No. 12/415,606, filed on Mar. 31, 2009, now Pat. No. 8,228,052.

(51) Int. Cl.
*G05F 3/30* (2006.01)

(52) U.S. Cl.
USPC ..... 323/311

(58) Field of Classification Search
USPC ..... 323/312–317, 908, 311; 327/539, 327/542, 513
See application file for complete search history.

(56) References Cited

U.S. PATENT DOCUMENTS

| | | | | |
|---|---|---|---|---|
| 4,677,368 | A * | 6/1987 | Bynum | 323/311 |
| 6,181,121 | B1 * | 1/2001 | Kirkland et al. | 323/313 |
| 8,228,052 | B2 * | 7/2012 | Marinca | 323/313 |
| 2005/0285666 | A1 | 12/2005 | Garlapati et al. | |
| 2006/0103455 | A1 | 5/2006 | Zhang et al. | |
| 2008/0265860 | A1 | 10/2008 | Dempsey et al. | |
| 2009/0039949 | A1 | 2/2009 | Pietrobon | |

OTHER PUBLICATIONS

PCT International Search Report and Written Opinion for PCT/US2010/027977 mailed on May 18, 2010.

* cited by examiner

*Primary Examiner* — Harry Behm
(74) *Attorney, Agent, or Firm* — Kenyon & Kenyon LLP

(57) ABSTRACT

A system and method are provided for a PTAT cell with no resistors which can operate at low power, has less sensitivity to process variation, occupies less silicon area, and has low noise. Further, a system and method are provided to scale up the reference voltage and current through a cascade of unit cells. Still further, a system and method are provided for PTAT component to be fine-tuned, advantageously providing less process variability and less temperature sensitivity.

9 Claims, 7 Drawing Sheets

METHOD AND CIRCUIT FOR LOW POWER VOLTAGE REFERENCE AND BIAS CURRENT GENERATOR

CROSS REFERENCE TO RELATED APPLICATIONS

This application is a continuation of U.S. patent application Ser. No. 12/415,606, filed on Mar. 31, 2009, the contents of which is incorporated herein by reference in its entirety.

COPYRIGHT AND LEGAL NOTICES

A portion of the disclosure of this patent document contains material which is subject to copyright protection. The copyright owner has no objection to the facsimile reproduction by anyone of the patent document or the patent disclosure, as it appears in the Patent and Trademark Office patent files or records, but otherwise reserves all copyrights whatsoever.

FIELD OF THE INVENTION

The present invention relates generally to voltage references and in particular to voltage references implemented using bandgap circuitry. The present invention more particularly relates to a circuit and method which provides a Voltage Proportional to Absolute Temperature (PTAT) voltage which can be scaled and tuned.

BACKGROUND INFORMATION

A conventional bandgap voltage reference circuit is based on the addition of two voltage components having opposite and balanced temperature slopes.

FIG. 1 illustrates a symbolic representation of a conventional bandgap reference. It consists of a current source, 110, a resistor, 120, and a diode, 130. It will be understood that the diode represents the base-emitter junction of a bipolar transistor. The voltage drop across the diode has a negative temperature coefficient, TC, of about −2.2 mV/° C. and is usually denoted as a Complementary to Absolute Temperature (CTAT) voltage, since its output value decreases with increasing temperature. This voltage has a typical negative temperature coefficient according to equation 1 below:

$$V_{be}(T) = V_{G0}\left(1 - \frac{T}{T_0}\right) + V_{be}(T_0) * \frac{T}{T_0} - \sigma * \frac{KT}{q} * \ln\left(\frac{T}{T_0}\right) + \frac{KT}{q} * \ln\left(\frac{Ic(T)}{Ic(T_0)}\right) \quad \text{(Eq. 1)}$$

Here, $V_{G0}$ is the extrapolated base-emitter voltage at zero absolute temperature, of the order of 1.2V; T is actual temperature; $T_0$ is a reference temperature, which may be room temperature (i.e. T=300K); $V_{be}(T_0)$ is the base-emitter voltage at $T_0$, which may be of the order of 0.7V; σ is a constant related to the saturation current temperature exponent, which is process dependent and may be in the range of 3 to 5 for a CMOS process; K is the Boltzmann's constant, q is the electron charge, $I_c(T)$ and $I_c(T_0)$ are corresponding collector currents at actual temperatures T and $T_0$, respectively.

The current source 110 in FIG. 1 is desirably a Proportional to Absolute Temperature (PTAT) source, such that the voltage drop across resistor 120 is PTAT voltage. As absolute temperature increases, the voltage drop across resistor 120 increases as well. The PTAT current is generated by reflecting across a resistor a voltage difference ($\Delta V_{be}$) of two forward-biased base-emitter junctions of bipolar transistors operating at different current densities. The difference in collector current density may be established from two similar transistors, i.e. Q1 and Q2 (not shown), where Q1 is of unity emitter area and Q2 is n times unity emitter area. The resulting $\Delta V_{be}$, which has a positive temperature coefficient, is provided in equation 2 below:

$$\Delta V_{be} = V_{be}(Q_1) - V_{be}(Q_2) = \frac{KT}{q} * \ln(n) \quad \text{(Eq. 2)}$$

In some applications, for example low power applications, the resistor 120 may be large and even dominate the silicon die area, thereby increasing cost. Therefore, it is desirable to have PTAT voltage circuits which are resistorless. PTAT voltages generated using active devices may be sensitive to process variations, via offsets, mismatches, and threshold voltages. Further, active devices used in PTAT voltage cells may contribute to the total noise of the resulting PTAT voltage. One goal of an embodiment of the present invention is to provide a resistorless PTAT cell operable at low power with little sensitivity to process variations and having low noise.

FIG. 2 illustrates the operation of the circuit of FIG. 1. By combining the CTAT voltage, V_PTAT of diode 130 with the PTAT voltage, V_PTAT, from the voltage drop across resistor 120, it is possible to provide a relatively constant output voltage Vref over a wide temperature range (i.e. −50° C. to 125° C.). This base-emitter voltage difference, at room temperature, may be of the order of 50 mV to 100 mV, for n from 8 to 50.

To balance the voltage components of the negative temperature coefficient from equation 1 and the positive temperature coefficient of equation 2, it is desirable to have the capability of fine-tuning the PTAT component to improve the immunity to process variations. Accordingly, in another embodiment of the present invention, a goal is to provide a fine-tune capability of the PTAT component.

In yet another embodiment of the present invention, it is a goal to multiply the ΔVbe component of transistors which are operated at different current densities to provide a higher reference voltage which is insensitive to temperature variations.

BRIEF DESCRIPTION OF THE DRAWINGS

The invention is illustrated in the figures of the accompanying drawings, which are meant to be exemplary and not limiting, and in which like references are intended to refer to like or corresponding parts.

DETAILED DESCRIPTION

A system and method are provided for a PTAT cell with no resistors which can operate at low power, has less sensitivity to process variation, occupies less silicon area, and has low noise. In another aspect of the invention, a system and method are provided to scale up the reference voltage and current. In yet another aspect of the present invention, a system and method are provided for a PTAT component to be fine-tuned.

Figure 1:
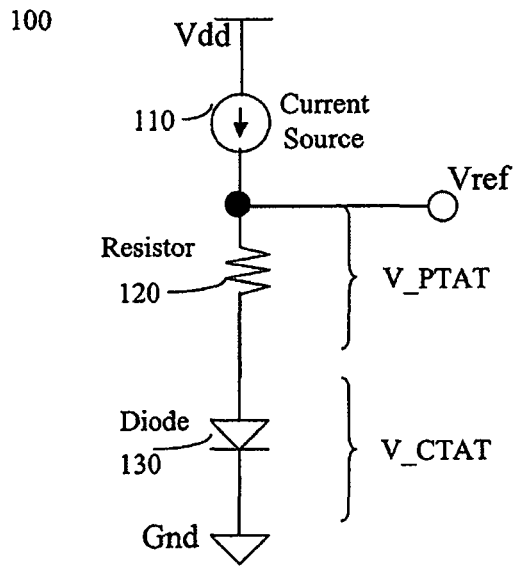
Fig. 1 Prior Art
FIG. 1 shows a known bandgap voltage reference circuit.
Figure 2:
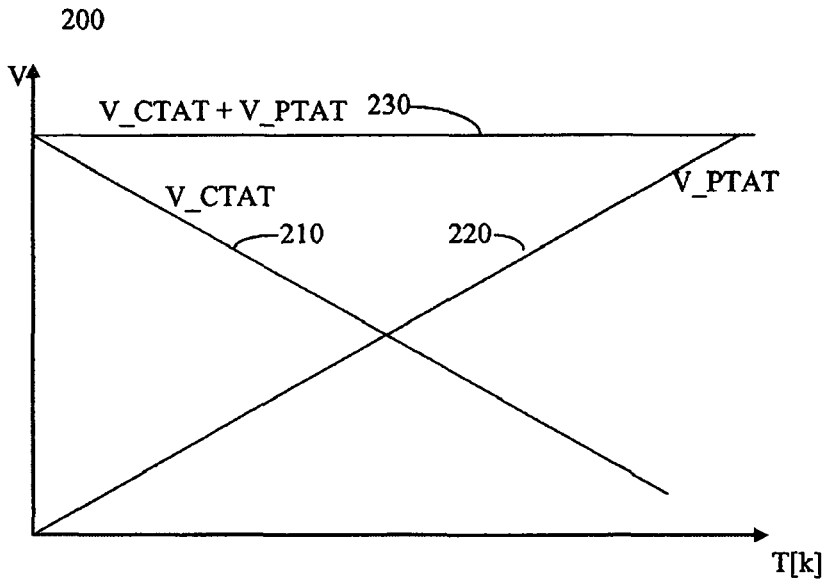
Fig. 2 Prior Art
FIG. 2 is a graph that illustrates how PTAT and CTAT voltages generated through the circuit of FIG. 1 may be combined to provide a reference voltage.
Figure 3A:
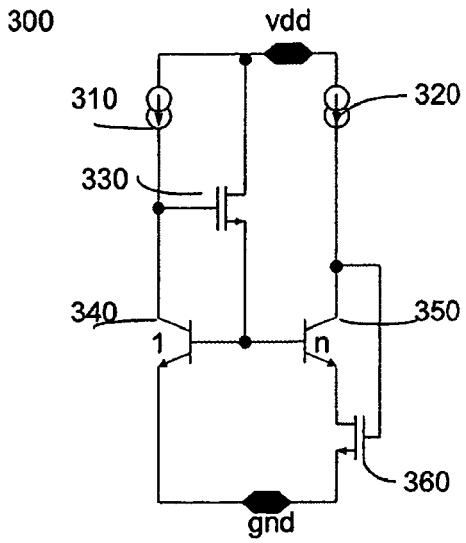
FIG. 3*a* shows a resistorless PTAT unit cell in accordance with an embodiment of the present invention.

The resistorless PTAT cell of FIG. 3*a* is an embodiment of an aspect of the present invention. Circuit 300 includes a first set of circuit elements arranged to provide a complimentary to absolute temperature (CTAT) voltage. For example, the first set of circuit elements may comprise transistors 330 and 340, which are supplied by current source 310. Transistor 330 may be, for example, an NMOS. A second set of circuit elements are arranged to provide a proportional to absolute temperature (PTAT) voltage or current. For example, the second set of circuit elements may comprise at least transistor 350 and active element 360. Transistor 350 is supplied by current source 320. In one embodiment, active device 360 may be an NMOS. Transistors 340 and 350 may be bipolar transistors.

Transistor 350 of the second set of circuit elements is configured such that it has an emitter area n times larger than transistor 340 of the first set of circuit elements. Thus, if the current sources 310 and 320 provide the same current, and the current through the gate of transistor 360 can be neglected, transistor 340 operates at n times the current density of transistor 350. In one embodiment, transistor 330 of the first set of circuit elements, supplies the base currents of transistors 340 and 350. Further, transistor 330 may also control the base-collector voltage of transistor 340 to minimize its Early effect. Transistor 360 also has several roles. First, at the emitter of transistor 350, it generates, via feedback, the base-emitter voltage difference in accordance with the collector current density of the ratio of transistors 340 and 350. Second, it limits the collector voltage of transistor 350, thereby reducing the Early effect of transistor 350. The aspect ratio (W/L) of transistors 330 and 360 can be chosen such that, at first order, the base-collector voltages of transistor 340 and transistor 360 track each other to minimize the Early Effect.

The PTAT voltage at the drain of transistor 360 of FIG. 3*a* is provided in equation 1 below:

$$V_{PTAT} = \frac{kT}{q}\ln\left(n * \frac{I_1}{I_2}\right) \quad \text{(Eq. 1)}$$

Thus, when currents I1 (310) and I2 (320) have similar temperature dependency, the resulting voltage is purely PTAT. For example, if the two currents I1 (310) and I2 (320) are constant and they track each other, the voltage at the drain of transistor 360 is PTAT.

Figure 3B:
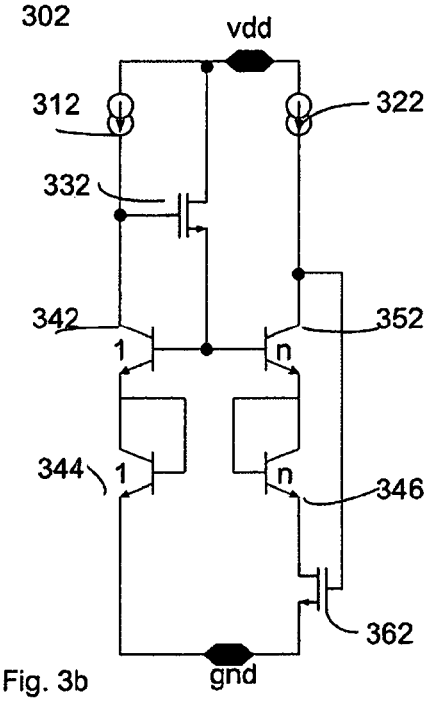
FIG. 3*b* shows a resistorless PTAT unit cell with a stack of additional transistors in accordance with an embodiment of the present invention.

For a larger PTAT voltage, a stack configuration can be used. For example, FIG. 3*b* illustrates an embodiment of a resistorless voltage reference with a stack configuration. With the additional stack transistors 344 and 346 the base-emitter voltage difference, ΔVbe, is provided in equation 1b below.

$$\Delta V_{be} = V_{PTAT} = 2 * \frac{kT}{q}\ln\left(n * \frac{I_1}{I_2}\right) \quad \text{(Eq. 1b)}$$

Figure 4:
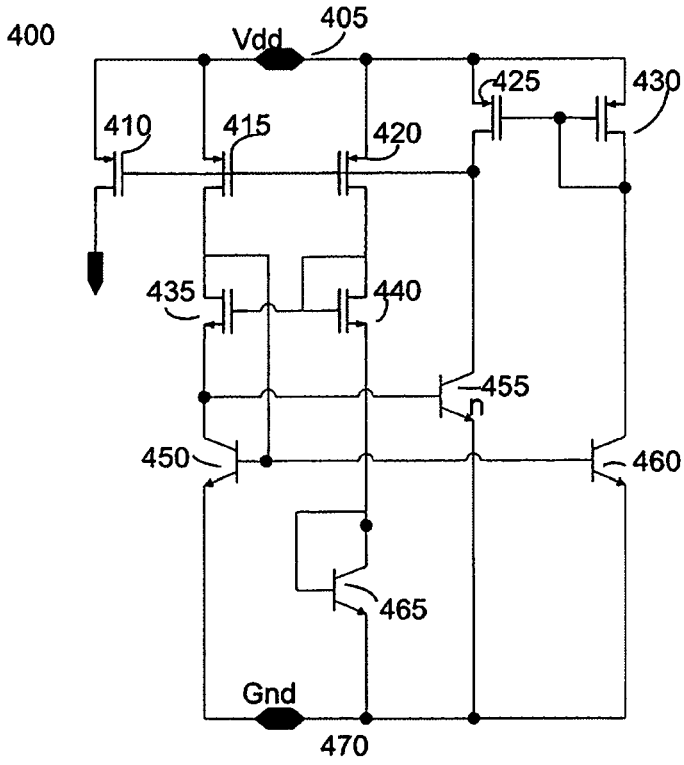
FIG. 4 shows an embodiment of a resistorless bias generator.

The two bias currents 310 and 320 of FIG. 3*a*, or 312 and 322 of FIG. 3*b*, can also be generated from a resistorless bias generator. FIG. 4 illustrates an exemplary embodiment of a resistorless bias generator wherein the base-emitter voltage difference of two bipolar transistors 450 and 455 is reflected across a transistor 435. In one embodiment, bipolar transistor 455 has n times the emitter area as bipolar transistor 450, and transistor 435 is an NMOS operated in the linear region. The bias gate voltage of transistor 435 is supplied by two diode connected transistors, transistor 440 and transistor 465. In one embodiment transistor 440 is an NMOS and transistor 465 is a bipolar transistor. Both transistors 440 and 465 are biased with the same current as transistor 435. Accordingly, transistors 435 and 440 track each other and transistor 435 is kept in the linear region.

In one embodiment, a first amplifier stage may be provided by bipolar transistors 455 and 460 and PMOSs 425 and 430. The gates of PMOSs 410, 415, and 420 are driven by the drain of transistor 425, representing the output of the first stage. A second stage amplifier stage is provided by PMOS 415, which supplies a current to transistor 435, which reflects the base-emitter difference of transistors 450 and 455.

Figure 5:
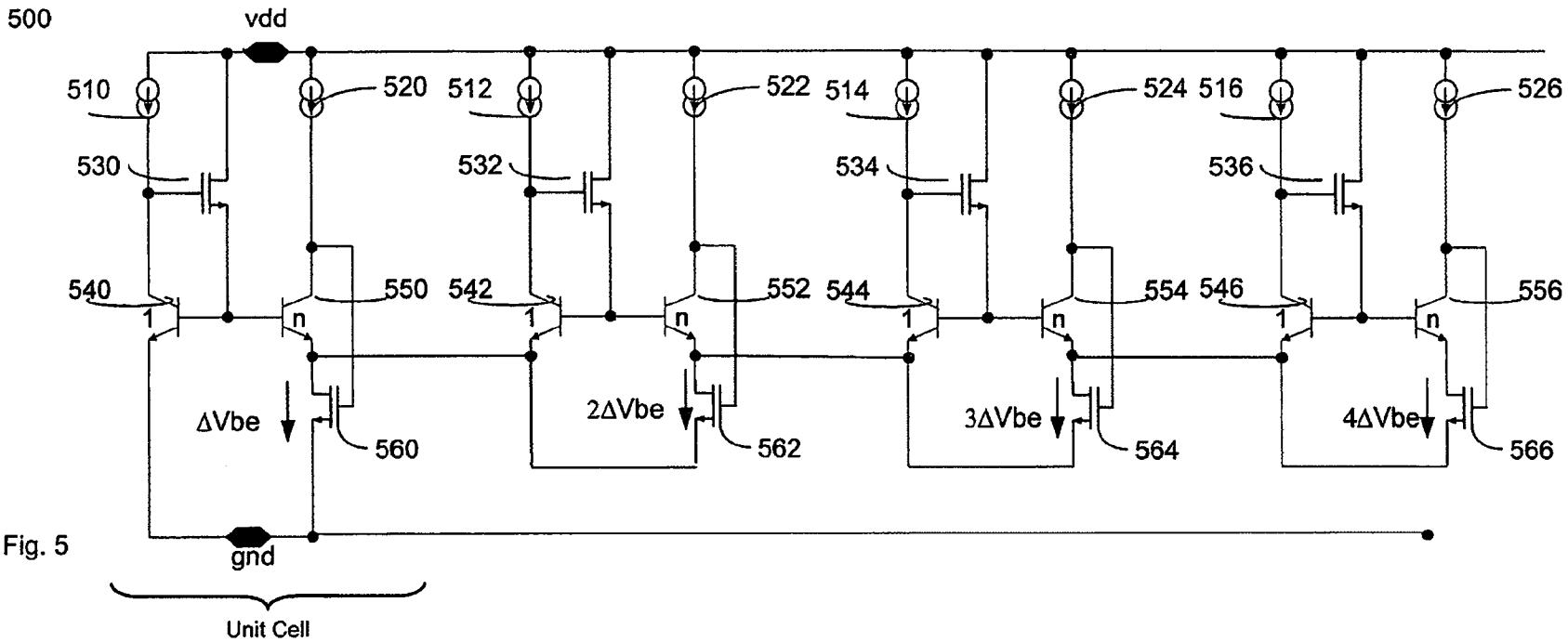
FIG. 5 shows an embodiment of a voltage cascading circuit.

FIG. 5 shows a voltage cascading circuit 500 in accordance with an embodiment of the present invention. For example, if a voltage larger than 100 mV at room temperature is desired, the unit cell 300 of FIG. 3*a* or FIG. 3*b* can be cascaded as illustrated in the example of FIG. 5. Accordingly, in this example, the output voltage of the circuit is four times the corresponding base-emitter voltage difference of transistor 550 to transistor 540. In this regard, the voltage cascading circuit 500 can be further extended by including additional unit cells similar to circuit 300 or 302. The averaging effect of the compound base-emitter voltage difference of circuit 500 advantageously provides additional consistency and is even less subject to the influence from the respective MOSFETs.

Figure 3C:
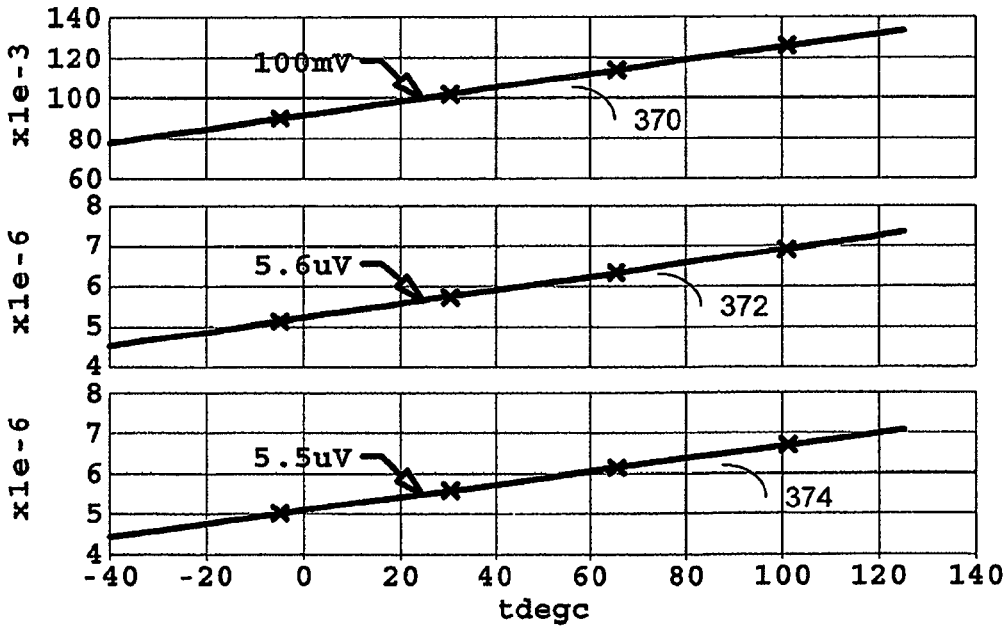
FIG. 3*c* shows PTAT voltage output vs. temperature in accordance with an embodiment of the present invention.

Advantageously, the circuits 300, 302, and 500, of FIGS. 3*a*, 3*b*, and 5, respectively, are affected very little by the offset voltages and noise introduced by any MOSFET, for example NMOSs 330 and 360. FIG. 3*c* provides simulation results of the PTAT voltage sensitivity to the offset voltage of NMOS transistors 330 and 360 in accordance with circuit 300. The parameters used in simulations include: I1=I2=10 μA, and n=48. Curve 370 represents the PTAT voltage output vs. temperature, for zero offset voltage of NMOSs 330 and 360. Curve 372 represents the difference of two PTAT voltages in accordance with circuit 300, the first PTAT voltage having a configuration where NMOS 330 has no offset voltage and the second PTAT voltage has a configuration where NMOS 330 has a 10 mV offset. Similarly, curve 374 represents the difference of two PTAT voltages, the first PTAT voltage having a configuration where NMOS 360 has no offset voltage and the second PTAT voltage has a configuration where NMOS 360 has a 10 mV offset. As evidenced by these curves, a large 10 mV offset for NMOSs 330 and 360 of FIG. 3*a* may have a less than 0.006% effect on the output.

Figure 3D:
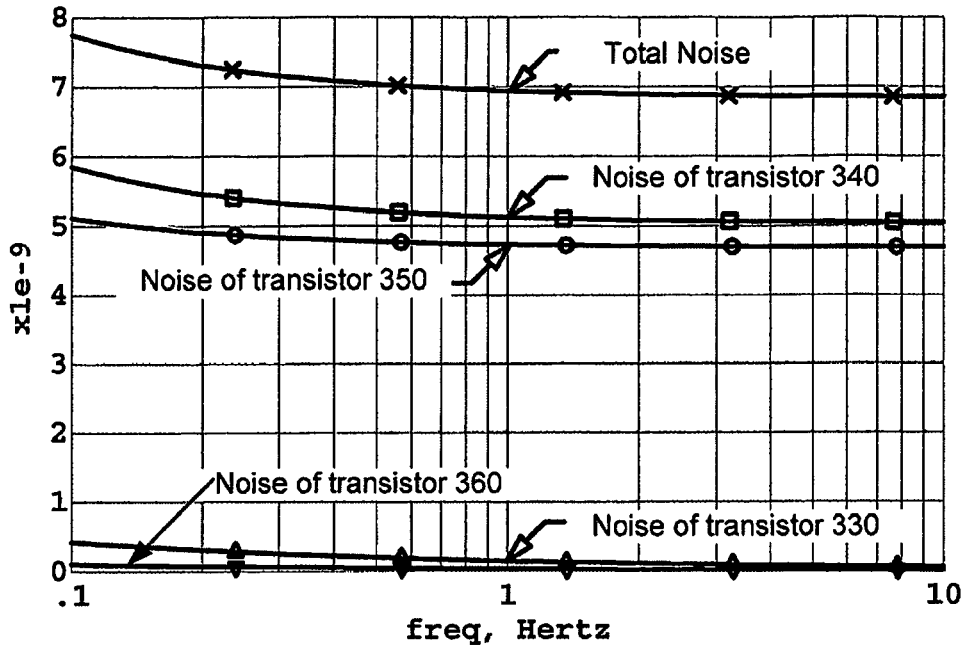
FIG. 3*d* shows simulation results of the noise contribution of different components of a voltage reference circuit in accordance with an embodiment of the present invention.

FIG. 3*d* shows simulation results of the spectral noise density and its components in 0.1 Hz to 10 Hz band for circuit 300 with the same aforementioned simulation parameters. As illustrated, noise contributions of transistors 330 and 360 are negligible compared to transistors 340 and 350.

As FIGS. 3*c* and 3*d* illustrate, the Δ base-emitter voltage across transistor 360 of the unit cell circuit 300 is very consistent and is subject to very little influence from transistors 330 and 360. An additional benefit of the configuration of circuit 300 includes its simplicity of design. Further, circuit configuration 300 consumes little power and is, thus, compatible with low power applications. Still further, circuit 300 occupies less silicon die area as compared to a conventional bandgap reference circuit which is configured with a resistor. As provided in the foregoing discussion, a resistor may even dominate the silicon die area, especially in low power applications. In this regard, the resistorless configuration of 300 saves silicon area. Further, transistors 330 and 350 may share wells and thus can be placed very close to one another, further reducing silicon area.

Figure 6:
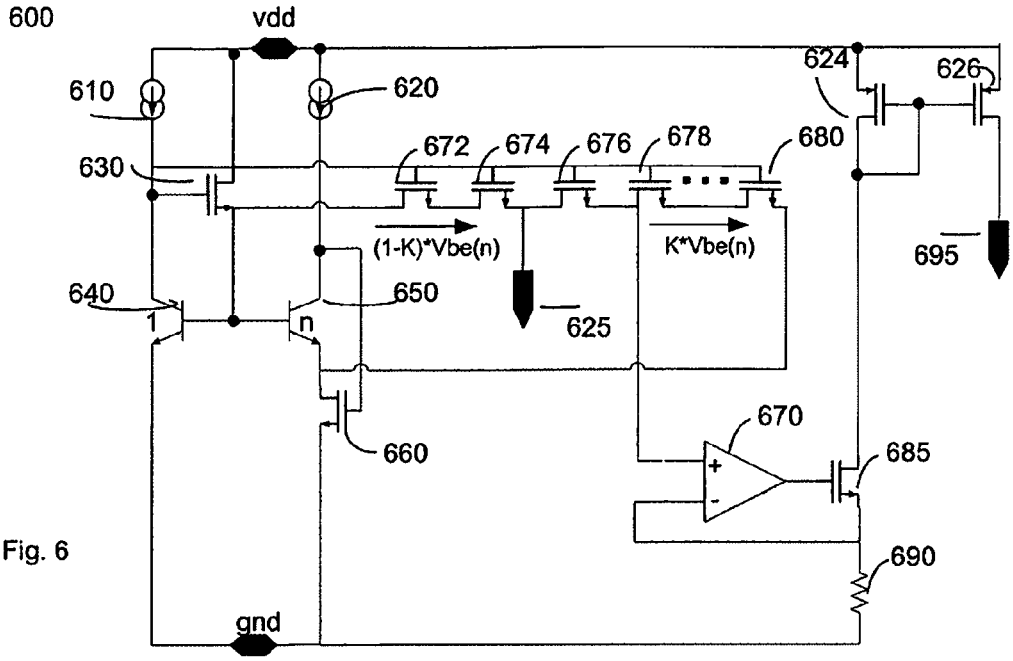
FIG. 6 shows another embodiment of the present invention in which a reference voltage is generated by adding a PTAT voltage to a base-emitter voltage fraction.

FIG. 6 illustrates another embodiment of the present invention. Circuit 600 includes a first set of circuit elements arranged to provide a complimentary to absolute temperature (CTAT) voltage or current. For example, the first set of circuit elements may comprise transistors 630 and 640, which is supplied by current source 610. Transistor 630 may be, for example, an NMOS.

A second set of circuit elements are arranged to provide a proportional to absolute temperature (PTAT) voltage or current. For example, the second set of circuit elements may comprise at least transistor 650 and of active element 660. Transistor 650 is supplied by current source 620. In one embodiment, active device 660 may be an NMOS or PMOS. Transistors 640 and 650 may be bipolar transistors. The configuration of circuit components 610, 620, 630, 640, 650, and 660 of FIG. 6 is substantially similar to the configuration of unit cell circuit 300 of FIG. 3*a*. Therefore, many of the features described in the context of circuit 300 also apply here.

In the exemplary embodiment of FIG. 6, transistor 630 of the first set of circuit elements, supplies the base currents of transistors 640 and 650, controls the base-collector voltage of transistor 640 to minimize its Early effect, and it also supplies the bias current into a third set of circuit elements.

In the exemplary embodiment of FIG. 6, a third set of circuit elements may comprise a plurality of resistances. For example, FIG. 6 illustrates resistances 672, 674, 676, 678, and 680. In one embodiment, the resistances 672 to 680 may be NMOSs operated in the linear (or triode) region. The number of resistances depends on the resolution of the desired base-emitter division. The third set of circuit elements divide the CTAT voltage output by the series of resistances 672 to 680, such that the output voltage at node 625 is temperature independent. Thus, the CTAT component can be further calibrated, advantageously offering a more stable output. For example, different fractions of the base-emitter voltage of transistor 650 can be added to the base-emitter voltage difference to compensate for the temperature dependency, thereby generating a reference voltage output 625 which is more temperature independent and less sensitive to process variations.

In one embodiment, the string of NMOSs (i.e., 672, 674, 676, 678, and 680) may have different gate to source voltages. Further, these NMOSs may be subject to the body effect. In this regard, the base-emitter voltage of transistor 556 may be unevenly distributed across these string of NMOSs. The voltage drop across the string of NMOSs can be balanced by scaling their respective aspect ratio (W/L).

The fourth set of circuit elements are arranged to provide a temperature independent current output 695. In one embodiment, the fourth set of circuit elements may comprise amplifier 670, transistors 624, 626, and 685, resistance 690, and output 695. For example, a combination of a PTAT voltage and a fraction of base-emitter voltage of transistor 660 is applied to the non-inverting terminal of amplifier 670. The negative terminal is connected to resistance 690 which may be a resistor (or an NMOS operated in the linear region.) Since there is a virtual zero voltage difference between the positive and negative inputs of the amplifier 670, substantially the same voltage as in the positive terminal of amplifier 370 is forced on the negative terminal. Accordingly, the voltage at the non-inverting input of the amplifier 670 is seen across resistance 690, thereby creating a current proportional to this voltage divided by the magnitude of resistance 690. The voltage at the non-inverting terminal of amplifier 670 is configured to have a specific temperature variation to compensate for the temperature coefficient of resistance 690. Thus, the tapping node (an emitter of transistors 672 to 680) that provides a temperature coefficient opposite to that of resistance 690 is chosen as the input to the non-inverting terminal of amplifier 670. In the exemplary embodiment of FIG. 6, the source of transistor 676 is used as this input. In one embodiment, this input voltage may be low, for example in the order of 200 mV as compared to traditional approaches relying on the typical bandgap voltage of about 1.2V. Advantageously, using a low input voltage saves power and allows using a smaller resistance 690, thereby further reducing chip area.

The output of amplifier 670 drives the gate of transistor 685, which may be an NMOS. Since amplifier 670 provides nearly no current at the gate of transistor 685, the current from the drain to source of transistor 685 is substantially the same as the current through resistance 690. Transistors 624 and 626 are configured as current mirrors reflecting this current at output 695. Thus, a constant current is provided at output 695, which is independent of temperature variations.

Figure 7:
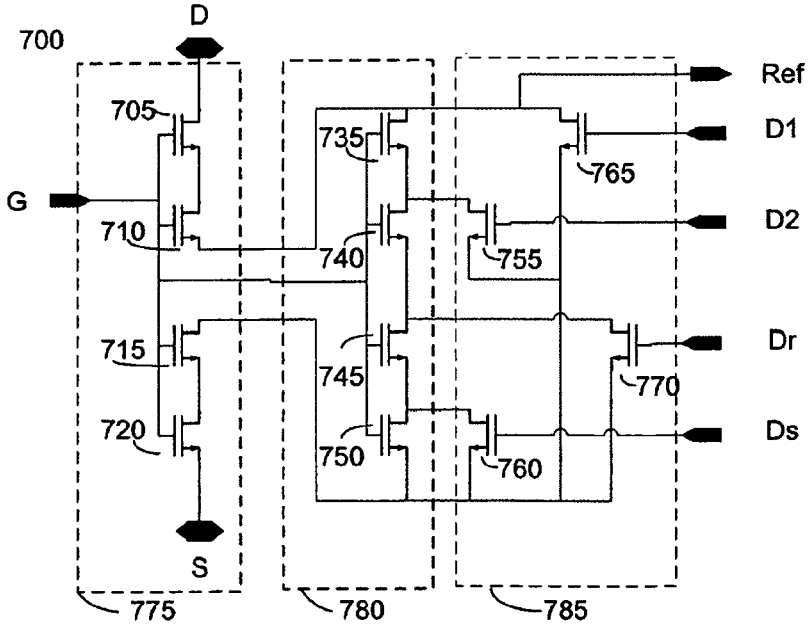
FIG. 7 shows a base-emitter digital voltage divider in accordance with an embodiment of the present invention.

In one embodiment the reference voltage at the output 625 can be digitally trimmed by selectively shorting the series of resistances. In this regard, FIG. 7 provides an embodiment of a digitally controlled base-emitter voltage. Circuit 700 of FIG. 7 may replace the base-emitter divider of resistances 672, 674, 676, 678 and 680 of FIG. 6. In another embodiment, the output may be tapped at a corresponding node between the source of NMOS transistor 750 and the drain of NMOS transistor 735. The voltage from nodes D and S is distributed across two strings: a coarse string and a fine string. In one embodiment, coarse string 775 may comprise transistors 705, 710, 715, and 720. The fine string 780 may comprise transistors 735, 740, 745, and 750. In one embodiment, the transistors of the coarse string 775 and fine string 780 are NMOS. Each drain of the NMOS transistors from fine string 780 can be shorted to the source of NMOS 750, via a digital interface consisting of NMOS transistors, 765 and 760, and an input interface, D1 to Ds. Thus, the user can determine the exact ratio. The reference voltage value at node Ref corresponds to the PTAT voltage at the node S plus the base-emitter fraction between nodes S and Ref, depending on the input code, D1 to Ds.

Figure 8:
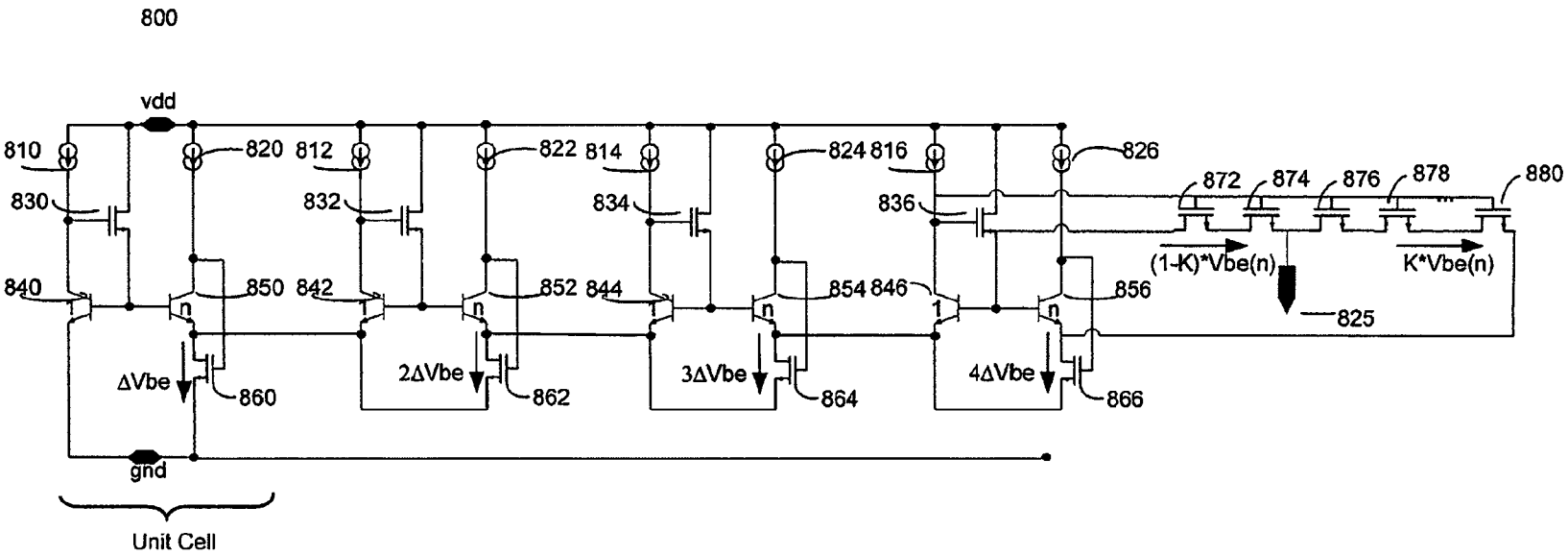
FIG. 8 shows an embodiment of a reference voltage based on a cascading PTAT voltage plus a fraction of the base-emitter voltage.

FIG. 8 shows a reference voltage circuit with a cascading PTAT configuration which generates a large PTAT, wherein the PTAT output is divided by a series of resistances, in accordance with an embodiment of the present invention. In one embodiment the base-emitter voltage of the last transistor from the chain (i.e., bipolar transistor 856) is divided via NMOS transistors 872, 874, 876, 878, and 880, such that a temperature independent voltage is generated. Circuit 800 of FIG. 8 is configured substantially similar to the cascade circuit 500 of FIG. 5 but includes a series of resistances substantially similar to the third set of circuit elements of circuit 600. Accordingly, the principles and benefits of a cascade configuration as well as the fractional division of the CTAT voltage discussed in the context of circuits 500 and 600 respectively, are applicable to circuit 800 as well. In the example of FIG. 8, a chain of four unit cells (each substantially consistent with circuit 300) may be used to generate a voltage which is four times the PTAT voltage of the unit cell. In one stage (i.e., the last) the a series of resistances 872, 874, 876, 878, and 880, divide the base-emitter voltage of bipolar transistor 856, as discussed in the context of FIG. 6, providing a fine-tuned temperature independent voltage reference at output 825.

Figure 9:
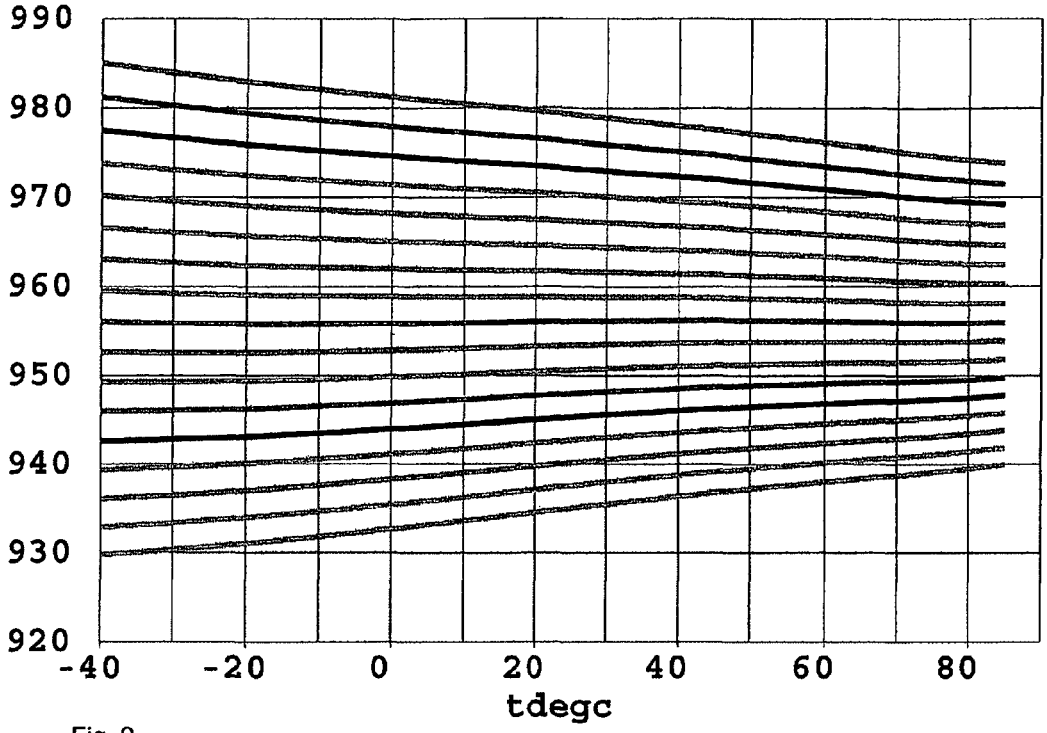
FIG. 9 shows simulation results of different voltage values for different input codes in accordance with FIG. 7.

FIG. 9 shows simulation results of voltage reference circuit at different nodes of a resistive divider of a circuit including the digital trimming concepts of circuit 700 in accordance with an embodiment of the present invention. In this exemplary embodiment, the PTAT voltage is based on five unit cells. The supply current of the circuit is only 50 μA, including 10 nA output current (similar to output 695 of FIG. 6). As further regards the exemplary embodiment, the total supply current of the reference voltage output (similar to output 825 of FIG. 8) is approximately 150 nA. FIG. 9 shows different reference voltage plots selected at different emitter outputs, representing different output voltages vs. temperature in relation to different input codes. For example, the curves may represent the voltage over temperature at the emitter nodes of NMOSs 872 to 880 of FIG. 8. As FIG. 9 illustrates, different voltage slopes can be selected, the resolution depending on the number of transistors in the base-emitter voltage divider (i.e., resistances 872 to 880 of FIG. 8). In one embodiment, this tuning can be done via metal options. In another embodiment electrical or laser fuses may be used. In yet another embodiment, the tuning can be done digitally by activating appropriate MOS gates to select the desired output.

Those skilled in the art will readily understand that the concepts described above can be applied with different devices and configurations. Although the present invention has been described with reference to particular examples and embodiments, it is understood that the present invention is not limited to those examples and embodiments. The present invention as claimed, therefore, includes variations from the specific examples and embodiments described herein, as will be apparent to one of skill in the art. For example, bipolar transistors can be used instead of MOS transistors. Further, PNP's may be used instead of NPN's, and PMOSs may be used instead of NMOSs. Accordingly, it is intended that the invention be limited only in terms of the appended claims.

What is claimed is:

1. A circuit for generating a proportional to absolute temperature (PTAT) voltage, comprising:

a first bipolar transistor and a second bipolar transistor sharing a common base;

a first current source supplying current to the first transistor;

a second current source supplying current to the second transistor; and a resistorless active element connected between an emitter of the first transistor and an emitter of the second transistor, the active element also being connected in a feedback loop to a collector of the second transistor to generate, in accordance with a collector current density ratio of the first transistor and the second transistor, the PTAT voltage as a difference between a base-emitter voltage of the first transistor and a base-emitter voltage of the second transistor;

wherein the first transistor is operated at n times a current density of the second transistor.

2. A circuit for generating a proportional to absolute temperature (PTAT) voltage, comprising:

a first bipolar transistor and a second bipolar transistor sharing a common base;

a first current source supplying current to the first transistor;

a second current source supplying current to the second transistor;

a resistorless active element connected between an emitter of the first transistor and an emitter of the second transistor, the active element also being connected in a feedback loop to a collector of the second transistor to generate, in accordance with a collector current density ratio of the first transistor and the second transistor, the PTAT voltage as a difference between a base-emitter voltage of the first transistor and a base-emitter voltage of the second transistor; and a MOSFET which supplies a current to the common base of the first and the second transistors;

wherein a gate of the MOSFET is connected to a collector of the first transistor.

3. A circuit for generating a proportional to absolute temperature (PTAT) voltage, comprising:

a first bipolar transistor and a second bipolar transistor sharing a common base;

a first current source supplying current to the first transistor;

a second current source supplying current to the second transistor; and a resistorless active element connected between an emitter of the first transistor and an emitter of the second transistor, the active element also being connected in a feedback loop to a collector of the second transistor to generate, in accordance with a collector current density ratio of the first transistor and the second transistor, the PTAT voltage as a difference between a base-emitter voltage of the first transistor and a base-emitter voltage of the second transistor, wherein the active element is a MOSFET.

4. A circuit for generating a proportional to absolute temperature (PTAT) voltage, comprising:

a first bipolar transistor and a second bipolar transistor sharing a common base;

a first current source supplying current to the first transistor;

a second current source supplying current to the second transistor;

a resistorless active element connected between an emitter of the first transistor and an emitter of the second transistor, the active element also being connected in a feedback loop to a collector of the second transistor to generate, in accordance with a collector current density ratio of the first transistor and the second transistor, the PTAT voltage as a difference between a base-emitter voltage of the first transistor and a base-emitter voltage of the second transistor; and a series of resistances, each of the series of resistances having a respective output that can be tapped to obtain a fraction of a complementary to absolute temperature (CTAT) voltage generated at the circuit.

5. The circuit of claim 4, wherein the obtained fraction of the CTAT voltage is combined in the circuit with the PTAT voltage to generate a substantially temperature insensitive voltage.

6. The circuit of claim 4, wherein the CTAT voltage is developed between the common base and the emitter of the second transistor.

7. The circuit of claim 4, further comprising:

an amplifier having a first input connected to one of the outputs of the series of resistances, the amplifier having an output connected to a third transistor, the one of the outputs of the series of resistances being configured to control the amplifier to generate a substantially temperature insensitive current through the third transistor.

8. The circuit of claim 7, further comprising a resistor, a first terminal of the resistor connected to the third transistor and to a second input of the amplifier, a second terminal of the resistor connected to ground.

9. The circuit of claim 4, further comprising:

a MOSFET which supplies a current to the common base of the first and the second transistors.

* * * * *